US006382909B1

(12) United States Patent
Voorhees

(10) Patent No.: US 6,382,909 B1
(45) Date of Patent: May 7, 2002

(54) ROTARY TURNING APPARATUS

(75) Inventor: Peter G. Voorhees, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/312,328

(22) Filed: May 14, 1999

(51) Int. Cl.[7] ..... F04D 25/02; F16C 3/03; F16D 3/06

(52) U.S. Cl. ..... 415/124; 464/169

(58) Field of Search ..... 415/122.1, 123, 415/124, 124.1, 124.2, 201; 464/169, 182

(56) References Cited

U.S. PATENT DOCUMENTS

| | | | | | |
|---|---|---|---|---|---|
| 645,247 | A | | 3/1900 | Cantono | |
| 1,080,482 | A | | 12/1913 | Roberts | |
| 1,098,189 | A | | 5/1914 | Stocker | |
| 1,334,951 | A | * | 3/1920 | Fredriksson | 415/124.2 X |
| 3,643,969 | A | * | 2/1972 | Finley et al. | 279/4.08 |
| 3,981,610 | A | * | 9/1976 | Ernst et al. | 415/124.2 |
| 4,190,400 | A | * | 2/1980 | Sloan | 415/124.2 X |
| 4,536,132 | A | | 8/1985 | Tenney | |
| 4,781,211 | A | * | 11/1988 | Cormier | 137/383 |
| 4,932,835 | A | | 6/1990 | Sorokes | |
| 5,186,573 | A | * | 2/1993 | Flotow | 415/123 |
| 5,513,831 | A | * | 5/1996 | Seward | 251/96 |
| 5,684,345 | A | | 11/1997 | Suttner | |
| 5,813,829 | A | * | 9/1998 | Mazzotta | 415/123 |

* cited by examiner

*Primary Examiner*—John E. Ryznic
(74) *Attorney, Agent, or Firm*—Haynes and Boone, LLP

(57) ABSTRACT

A machine with a rotary turning apparatus in accordance with one embodiment of the present invention includes a housing with at least one end wall, at least one bearing assembly, a shaft, a passage, a pair of shoulders, an engagement device, and a biasing device. The shaft is mounted for rotation in the housing and on the bearing assembly. The passage extends through the wall to provide access to one end of the shaft. The engagement device has an end which is shaped to mate with the one end of the shaft and is mounted for movement in the passage between the pair of shoulders which are located on the wall in the passage. The biasing device is positioned between one of the shoulders and the collar which extends at least partially around the engagement device. The biasing device biases the one end of the engagement device away from engagement with the one end of the shaft. By compressing the biasing device, the end of the engagement device can be mated with the end of the shaft for manual rotation.

20 Claims, 3 Drawing Sheets

ROTARY TURNING APPARATUS

FIELD OF THE INVENTION

This invention relates generally to a mechanism for rotating a shaft of a machine and, more particularly, to a rotary turning apparatus for use in manually rotating the shaft of a steam turbine.

BACKGROUND OF THE INVENTION

Shafts need to be rotated in machines at slow speeds for a variety of different reasons. For example, some machines, such as compressors or turbines, use hot fluids, such as steam, during their operations. Often these fluids are not evenly distributed throughout the machine. As a result, some sections of these machines heat up more than others. When these machines complete their operations and are shut down, the shafts in these machines stop rotating and the heat stored in the machine begins to heat up the shaft. Since some sections of the machine are hotter than others, the portions of the shaft near those sections begin to heat up more rapidly than other portions of the shaft. Eventually this heating can cause an undesirable bowing of the shaft which can damage both the shaft and other parts of the machine. One technique to avoid this bowing problem is to rotate the shaft slowly as the machine cools to more evenly distribute the heat around the shaft.

Shafts in machines may also need to be rotated at slow speeds so that the machines can be inspected. Often by rotating the shaft, an operator is provided with a better angle to inspect internal components or elements which are mounted on the shaft or are located in the housing.

Several different types of devices have been developed to rotate the shafts of these machines at slow speeds, but each of these prior devices has drawbacks and/or limitations. For example, electric or gas powered systems have been developed to automatically rotate the shafts of these machines at slow speeds. Unfortunately, these systems are often expensive and involve complicated designs. Additionally, these systems often add significantly to the overall size of the machines which may need to fit into relatively tight quarters when in use. Further, the installation of these systems is often difficult and time consuming. Accordingly, there is a need for a simple, inexpensive, and compact apparatus for rotating the shaft of a machine which can be easily installed.

SUMMARY OF THE INVENTION

A rotary turning apparatus in accordance with one embodiment of the present invention includes an engagement device with at least one end and a biasing device. The one end of the engagement device is shaped to mate with one end of a shaft. The shaft is mounted for rotation in a housing and is accessible via a passage in a wall in the housing. The biasing device is disposed substantially within the passage in the wall and biases the one end of the engagement device away from engagement with the one end of the shaft. By compressing the biasing device, the end of the engagement device can be mated with the end of the shaft for manual rotation of the shaft.

A machine with a rotary turning apparatus in accordance with another embodiment of the present invention includes a housing with at least one wall, a shaft, a passage extending through the wall, at least one shoulder, a collar, and a biasing device. The shaft is mounted for rotation in the housing. The housing includes at least one passage which extends through the wall and provides access to one end of the shaft. The shoulder is located on the wall in the passage. The engagement device has an end which is shaped to mate with the one end of the shaft and is mounted for movement within the passage. The biasing device is positioned between the shoulder and a collar which extends at least partially around the engagement device. The biasing device biases the one end of the engagement device away from engagement with the one end of the shaft. By compressing the biasing device, the end of the engagement device can be mated with the end of the shaft for manual rotation of the shaft.

A machine with a rotary turning apparatus in accordance with yet another embodiment of the present invention includes a housing with at least one end wall, at least one bearing assembly, a shaft, a passage, a pair of shoulders, an engagement device, a biasing device, and a seal. The shaft is mounted for rotation in the housing and on the bearing assembly. The passage extends through the wall to provide access to one end of the shaft. The engagement device has an end which is shaped to mate with the one end of the shaft and is mounted for movement in the passage between the pair of shoulders which are located on the wall in the passage. The biasing device is positioned between one of the shoulders and the collar which extends at least partially around the engagement device. The biasing device biases the one end of the engagement device away from engagement with the one end of the shaft. By compressing the biasing device, the end of the engagement device can be mated with the end of the shaft for manual rotation of the shaft.

The rotary turning apparatus in accordance with the present invention provides a number of advantages. For example, one advantage of the present invention is the ease with which it can be used. By simply compressing the engagement device into a mating engagement with the shaft and then rotating the engagement device, the shaft of the machine can be rotated. The engagement device is conveniently spring loaded so that when it is not in use, the rotary turning apparatus is biased away from and will not interfere with the normal operation of the rotating shaft. Additionally, the rotary turning apparatus includes a seal to help minimize the loss of any fluid, such as oil, which is located in the housing of the machine.

Another advantage of the present invention is its compact and simple design. The simple design minimizes the number of necessary components and thus minimizes the overall size of the rotary turning apparatus and of the machine it is mounted on. As a result, the design is inexpensive to implement and it is unlikely that the additional size resulting from the inclusion of the present invention in the machine will prevent that machine from fitting into its desired location.

Further, the present invention provides a rotary turning apparatus which is relatively easy to install on new and existing machines. A substantial portion of the rotary turning apparatus is conveniently disposed within the wall of the housing. Not only does this provide a more aesthetically pleasing design, but it also enables new and existing machines to be more easily converted to incorporate the present invention. Basically, to retrofit an existing machine, the existing end wall of the housing is simply replaced with an end wall which incorporates the compactly designed and stored rotary turning apparatus.

DETAILED DESCRIPTION

Figure 1:
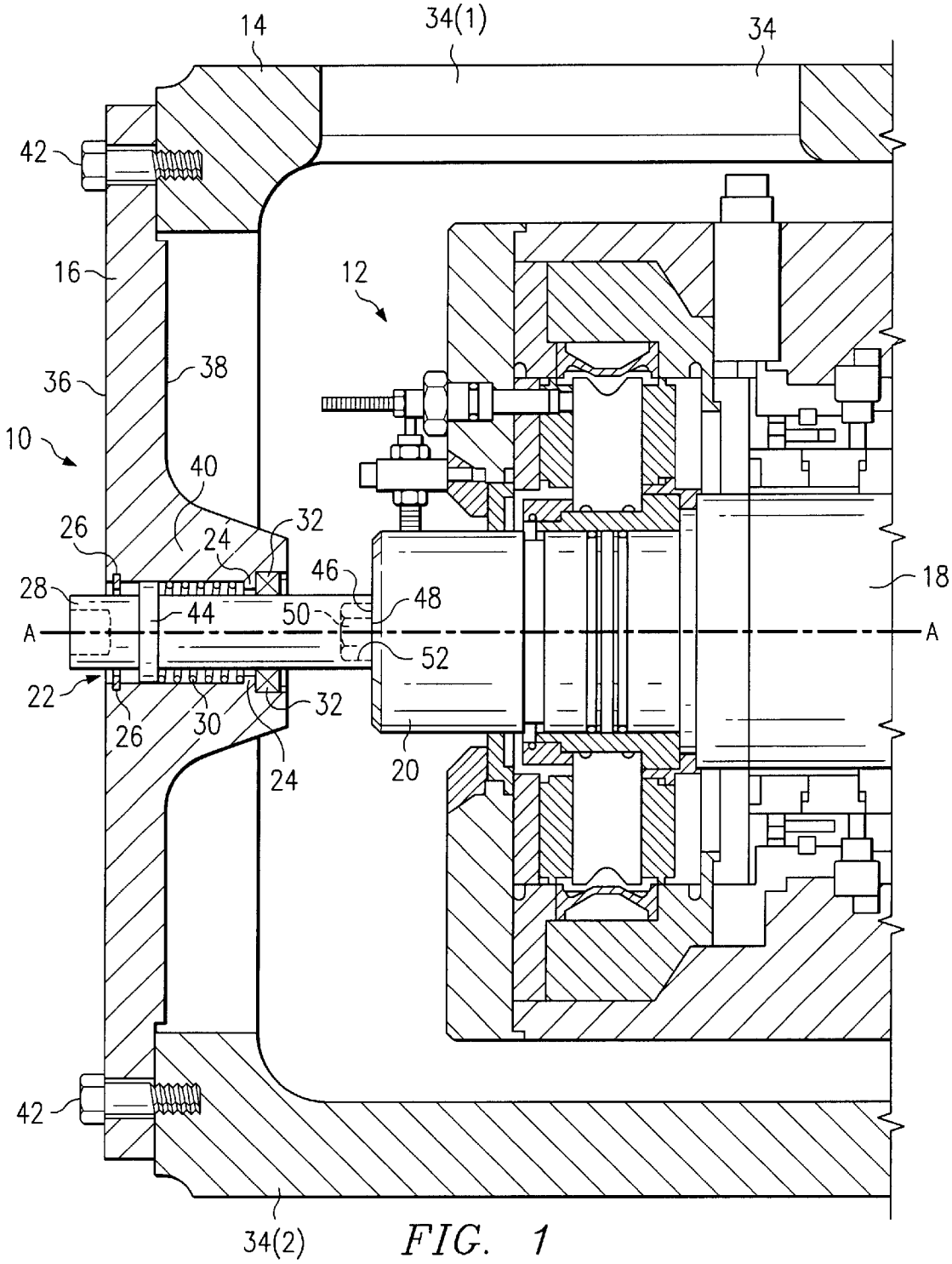
FIG. 1 is a cross-sectional side view of a machine with a rotary turning apparatus in an engaged position in accordance with one embodiment of the present invention.
Figure 2:
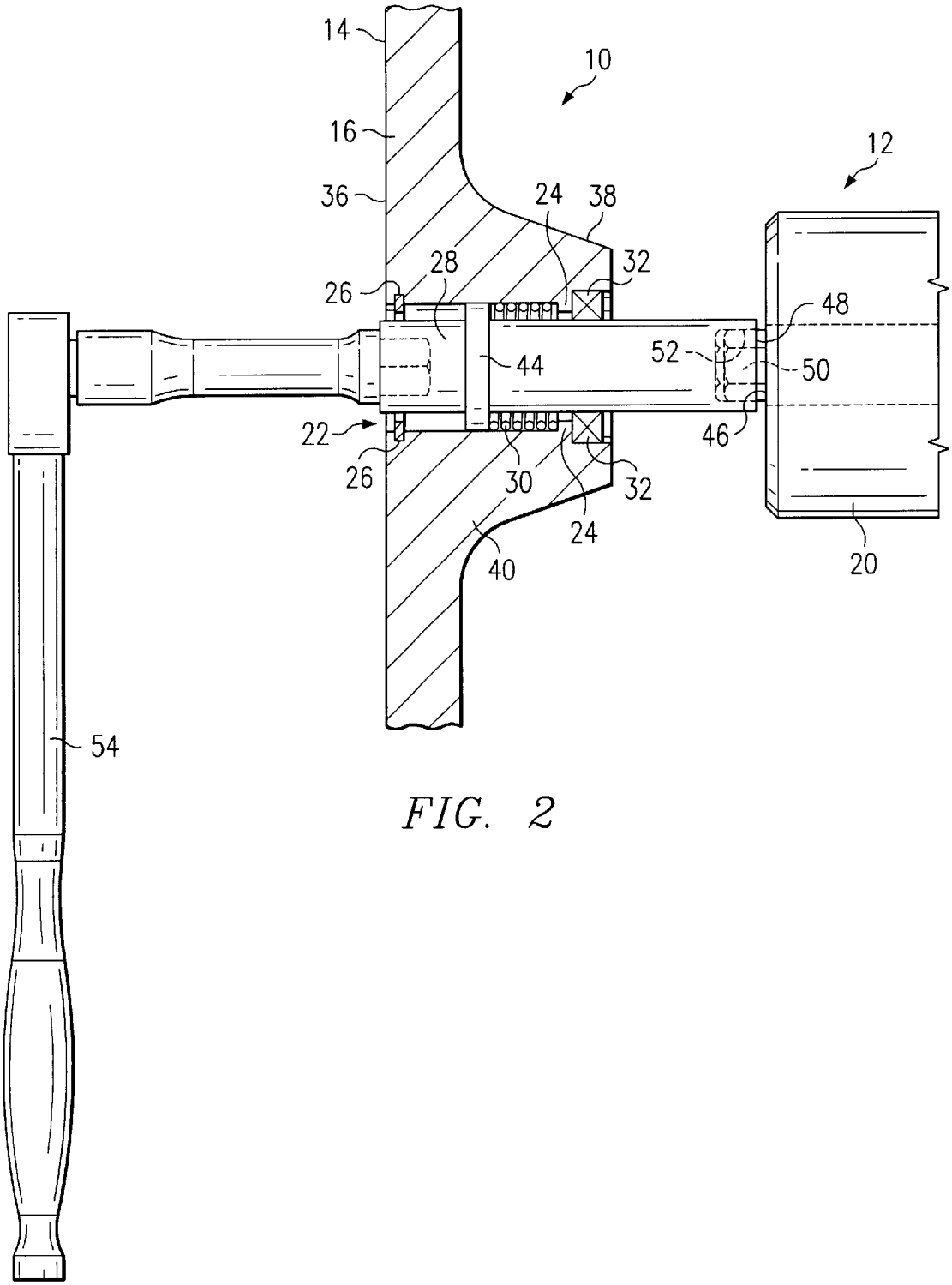
FIG. 2 is an enlarged, cross-sectional, side view of the rotary turning apparatus with a drive bar in an engaged position.
Figure 3A:
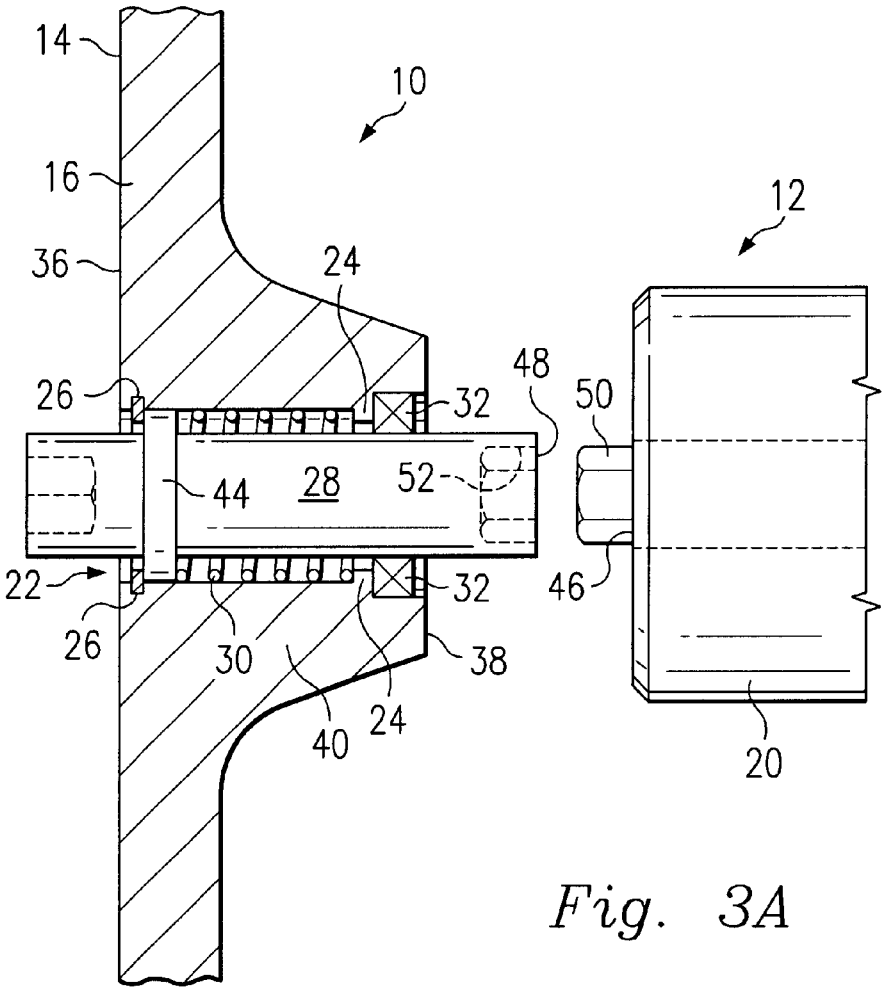
FIG. 3A is a cross-sectional top view of the rotary turning apparatus in a non-engaged position.
Figure 3B:
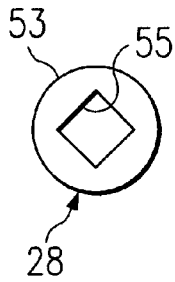
FIG. 3B is an end view of the engagement device in accordance with one embodiment of the present invention.

A rotary turning apparatus 10 in a machine 12 in accordance with one embodiment of the present invention is illustrated in FIGS. 1–3B. The rotary turning apparatus 10 includes a housing 14 with at least one end wall 16, at least one bearing assembly 18, a shaft 20, a passage 22, a pair of shoulders 24 and 26, an engagement device 28, a biasing device 30, and a seal 32. The invention provides a number of advantages including providing a rotary turning apparatus 10 which is easy to use, has a simple and compact design, and is easy to install on new and existing machines.

Referring more specifically to FIGS. 1–3B, a portion of a machine 12, in this example a compressor, is illustrated, although the present invention can be used with a variety of different types of machines, such as turbines. In this particular embodiment, the housing 14 of the machine 12 has a pair of end walls 16 (only one end wall is shown) and a central casing 34 which is split into two halves 34(1) and 34(2), although the housing 14 can have a variety of different types of configurations which employ different numbers of walls. The end wall 16 has an outer surface 36 and an inner surface 38 and in this particular embodiment an enlarged section 40, although the enlarged section 40 is not necessary. In this particular embodiment, the end wall 16 is secured to the central casing 34 by bolts 42, although other devices and methods for connecting the end wall 16 to the central casing 34, such as welding, could be used.

One of the advantages of the present invention is that the rotary turning apparatus 10 in accordance with the present invention is easy to install on new machines or as a retrofit on existing machines. A substantial portion of the rotary turning apparatus 10 is conveniently and compactly disposed within the end wall 16 of the machine 12. As a result, the end wall 16 merely needs to be bolted on to the central casing 34 of a new machine or with an existing machine, the existing end wall merely needs to be unbolted and replaced with an end wall 16 which incorporates the rotary turning apparatus 10.

The shaft 20 extends along a central axis A-A and is mounted for rotational movement about the central axis A-A in the housing 14. In this particular embodiment, the shaft 20 is mounted for rotational movement on an optional bearing assembly 18. The shaft 20 has a pair of opposing ends 46 (only one end is shown). One end 46 of the shaft 20 is designed to mate with one end 48 of the engagement device 28. Although in this particular example, the end 48 of the engagement device 28 is the female portion of the connection and the end 46 of the shaft 20 (or a projection 50 extending from end 46) is the male portion, other types of mating arrangements can be used. For example, the end 48 of the engagement device 28 may be the male portion of the connection and the end 46 of the shaft 20 or the projection 50 may be the female portion or the ends 46 and 48 of the engagement device 28 and the shaft 20 or projection 50 may each simply have a mating pattern without clearly defined male or female portions, such as an interlocking teeth design. An optional projection 50, such as bolt, may be mounted in the end 46 of the shaft 20 or in the end 48 of the engagement device 28 (not shown). If a projection 50 is used, the projection 50 is designed to mate with the one end 48 of the engagement device 28 or the one end 46 of the shaft 20.

The passage 22 extends through the enlarged section 40 of the end wall 16 from the outer surface 36 to the inner surface 38 to provide access to the one end 46 of the shaft 20, although the passage 22 could be located in other portions of the housing 14 which provide access to the one end 46 of the shaft 20. The passage 22 includes the pair of shoulders 24 and 26 which are spaced apart and are used to help retain a portion of the engagement device 28 in the passage 22. In this particular embodiment the shoulders 24 and 26 extend substantially around the passage 22 although they do not have to. Although shoulders 24 and 26 are illustrated in this particular example, other techniques for retaining the engagement device 28 within the passage 22 can also be used.

The engagement device 28 is mounted for movement within the passage 22 between the shoulders 24 and 26 in the wall 16, although other configurations for movement of the engagement device 28 within the passage 22 can also be used. The engagement device 28 has an end 48 which is designed to mate with the end 46 of the shaft 20. In this particular embodiment, the engagement device 28 is a socket with an opening 52 at the one end 48 which is designed to mate over either the end 46 of the shaft 20 or the projection 50 extending out from the end 46 of shaft 20. By way of example only, in this particular embodiment the engagement device 28 has a circular cross-sectional shape.

The collar 44 is used to control the movement of the engagement device 28 within the passage 22, although other techniques for controlling the movement of the engagement device 28 can also be used. In this particular embodiment, the collar 44 is located on and extends substantially around the engagement device 28, although the collar 44 may only extend around a portion of the engagement device 28 if desired. The collar 44 may be mounted on the engagement device 28 or may be integrally formed with the engagement device 28. In this particular embodiment, the outer envelope or shape of the collar 44 is substantially the same as the passage 22. Additionally, in this example the dimensions of collar 44 are smaller than the passage 22 to permit movement of the engagement device 28 in passage 22 and the dimensions of collar 44 are larger than the interior dimensions of shoulders 24 and 26 to keep the collar 44 in the passage 22.

The biasing device 30 is used to bias the one end 48 of the engagement device 28 away from the one end 46 of the shaft 20 so that the engagement device 28 does not interfere with the normal operation of the shaft 20. In this particular embodiment, the biasing device 30 is located in the passage 22 between one of the shoulders 24 and the collar 44 and is located around the engagement device 28, although the biasing device 30 can be located elsewhere, such as above and below the engagement device 28, but not around it. In this particular example, the biasing device 30 is a spring, although other types of and different numbers of biasing devices 30 can be used.

An optional seal 32 may be positioned between the engagement device 28 and the passage 22. The seal 32 is designed to prevent or minimize the loss of fluid, such as oil, out of the housing 14. In this particular embodiment, the seal 32 is connected to the passage 22 adjacent the inner surface 38 of the wall 16. By way of example only, in this particular embodiment the seal 32 has a circular shape.

A drive bar 54, such as a ratchet, may be used to compress the biasing device 30 to mate the end 48 of the engagement device 28 with the end 46 of the shaft 20 or the projection 50 and then to rotate the engagement device 28 and thus the shaft 20. In this particular embodiment, the drive bar 54 is detachably connected to the end 53 of the engagement device 28 which has an opening 55, although the drive bar 54 could be permanently connected to the engagement device 28 or connected in other matters well known to those of ordinary skill in the art.

As discussed and illustrated above, another advantage of the present invention is the simplicity and compactness of the design of the rotary turning apparatus 10. The present invention requires few components to implement. As a result, the present invention is significantly cheaper to implement and is significantly smaller than prior designs. Even with the rotary turning apparatus 10, a machine 12 will likely be able to fit into most locations where space is limited.

The operation of the rotary turning apparatus 10 in the machine 12 in accordance with one embodiment of the present invention will be discussed with reference to FIGS. 1–3B. When the rotary turning apparatus 10 is not in use, the end 48 of the engagement device 28 is biased away from the end 46 of the shaft 20 so that the engagement device 28 will not interfere with the operation of the shaft 20 or machine 12.

To engage the rotary turning apparatus 10, the drive bar 54 is used in this example to push the engagement device 28 and thus the collar 44 towards the shoulder 24 of the wall 16. This movement of the engagement device 28 causes the biasing device 30 to compress and will eventually mate the one end 48 of the engagement device 28 with the one end 46 of the shaft 20 or with projection 50. The rotary turning apparatus 10 should be used when the shaft 20 of the machine 12 has stopped rotating. Once the one end 48 of the engagement device 28 is engaged with the one end 46 of the shaft 20, the drive bar 54 can be rotated to rotate the engagement device 28 and thus the shaft 20 for as long as needed or desired. When the desired manual rotation is completed, pressure is simply released off of the drive bar 44 and thus the engagement device 28. When pressure is released, the biasing device 30 pushes the engagement device 28 towards shoulder 26 and thus pulls the end 48 of the engagement device 28 away from the end 46 of the shaft 20 and pushes the collar 44 of the engagement device 28 against the other shoulder 26. The shaft 20 is now free to rotate without interference from the rotary turning apparatus 10. As illustrated by the discussion above, the present invention provides an easy to use and effective mechanism for rotating the shaft of a machine.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A rotary turning apparatus for a shaft mounted for rotation in a housing with at least one wall, at least one passage extending through the wall which provides access to one end of the shaft, the rotary turning apparatus comprising:

an engagement device with at least one end, wherein the engagement device is mounted for movement within the passage in the wall and the one end of the engagement device is shaped to mate with the one end of the shaft; and a biasing device disposed substantially within the passage in the wall, the biasing device biasing the one end of the engagement device away from engagement with the one end of the shaft, wherein compression of the biasing device will mate the one end of the engagement device with the one end of the shaft.

2. The apparatus according to claim 1 further comprising a seal positioned between the engagement device and the passage in the wall.

3. The apparatus according to claim 1 further comprising a drive bar which is connected to the engagement device, wherein rotation of the drive bar when the end of the engagement device is engaged with the one end of the shaft rotates the shaft.

4. The apparatus according to claim 1 wherein the one end of the shaft comprises a male portion of a connection and the end of the engagement device comprises a female portion of the connection.

5. The apparatus according to claim 1 further comprising a projection mounted on to the one end of the shaft, wherein the projection engages with the one end of the engagement device to make a connection.

6. The apparatus according to claim 1 wherein the engagement device is a socket.

7. The apparatus according to claim 1 wherein the biasing device is a spring.

8. A machine comprising:

a housing with at least one wall;

a shaft mounted for rotation in the housing;

at least one passage in the wall, the passage providing access to one end of the shaft;

at least one shoulder located on the wall in the passage;

an engagement device having an end, wherein the engagement device is mounted for movement within the passage and the end of the engagement device is shaped to mate with one end of the shaft;

a collar on the engagement device, wherein the collar extends at least partially around the engagement device and is positioned within the wall; and a biasing device positioned between the shoulder and the collar, the biasing device biasing the one end of the engagement device away from engagement with the one end of the shaft, wherein compression of the biasing device will mate the end of the engagement device with the end of the shaft.

9. The machine according to claim 8 further comprising at least one bearing assembly, the shaft mounted for rotation on the bearing assembly.

10. The machine according to claim 8 further comprising a seal positioned between the engagement device and the passage in the wall.

11. The machine according to claim 8 further comprising a drive bar which is connected to the engagement device, wherein rotation of the drive bar when the end of the engagement device is engaged with the one end of the shaft rotates the shaft.

12. The machine according to claim 8 wherein the one end of the shaft comprises a male portion of the connection and the end of the engagement device comprises a female portion of the connection.

13. The machine according to claim 8 further comprising a projection mounted on to the one end of the shaft, wherein the projection engages with the end of the engagement device to make the connection.

14. The machine according to claim 8 wherein the engagement device is a socket.

15. The machine according to claim 8 wherein the biasing device is a spring.

16. A machine comprising:

a housing with at least one end wall;

at least one bearing assembly;

a shaft mounted for rotation in the housing and on the bearing assembly;

at least one passage extending through the wall, the passage providing access to one end of the shaft;

a pair of shoulders located on the wall in the passage;

an engagement device having an end, wherein the engagement device is mounted for movement within the passage between the shoulders and the end of the engagement device is shaped to mate with the one end of the shaft;

a collar on the engagement device, wherein the collar extends at least partially around the engagement device and is positioned between the pair of shoulders; and a biasing device positioned between one of the shoulders and the collar, the biasing device biasing the one end of the engagement device away from engagement with the one end of the shaft, wherein compression of the biasing device will mate the end of the engagement device with the end of the shaft.

17. The machine according to claim 16 further comprising a drive bar which is connected to the engagement device, wherein rotation of the drive bar when the end of the engagement device is engaged with the one end of the shaft rotates the shaft.

18. The machine according to claim 16 wherein the one end of the shaft comprises a male portion of the connection and the end of the engagement device comprises a female portion of the connection.

19. The machine according to claim 16 further comprising a projection mounted on to the one end of the shaft, wherein the projection engages with the end of the engagement device to make the connection.

20. The machine according to claim 16 further comprising a seal positioned between the engagement device and the passage in the end wall.

* * * * *